US005105717A

United States Patent [19]

Pond

[11] Patent Number: 5,105,717

[45] Date of Patent: Apr. 21, 1992

[54] COMPENSATOR SYSTEM FOR FIREARMS

[76] Inventor: Howard C. Pond, 520 S. Wynne St., Colville, Wash. 99114

[21] Appl. No.: 663,466

[22] Filed: Mar. 4, 1991

[51] Int. Cl.[5] ..... F41A 21/36

[52] U.S. Cl. ..... 89/14.3; 42/79

[58] Field of Search ..... 42/79; 89/14.3

[56] References Cited

U.S. PATENT DOCUMENTS

| | | | |
|---|---|---|---|
| 827,844 | 8/1906 | Bellamy | 42/76 |
| 1,390,658 | 9/1921 | Towson | 89/14.3 |
| 2,112,831 | 4/1938 | Cutts, Jr. | 89/14.3 |
| 2,668,479 | 2/1954 | Batten | 89/14.3 |
| 3,367,055 | 2/1968 | Powell | 42/79 |
| 3,858,481 | 1/1975 | Elliott | 89/14.3 |
| 4,715,140 | 12/1987 | Rosenwald | 89/14.3 |

*Primary Examiner*—Stephen C. Bentley
*Attorney, Agent, or Firm*—Sherman and Shalloway

[57] ABSTRACT

A compensator for fire arms includes a barrel bushing, outer tubular housing, and an inner tubular choke which defines an annular gas expansion chamber; the inner tubular choke has a plurality of holes formed therein which provides gas communication between the bore of the barrel, interior of the inner tubular choke, and annular gas expansion chamber; and spaced longitudinally extending slots are provided to the top and bottom of the outer tubular housing for gas communication between the annular gas expansion chamber and atmosphere, the ratio of the area of the slots in a top surface of the outer tubular housing to the area of the slots in the bottom of the outer tubular housing are about 3 to 1.

9 Claims, 1 Drawing Sheet

COMPENSATOR SYSTEM FOR FIREARMS

BACKGROUND OF THE INVENTION

1. FIELD OF THE INVENTION

The invention relates in general to a gun compensator, and, more particularly, to a compensator device which can be used with firearms and gun chokes to reduce muzzle blast, and to provide for better pattern and reduction of recoil with shot guns, and also to reduces the upward jump of a gun as projectile(s) exit the muzzle thereof.

2. DESCRIPTION OF THE PRIOR ART

It is known from U.S. Pat. No. 4,715,140 to use a bayonet-type mounting on a gun compensator. It is also known from U.S. Pat. Nos. 2,668,479 and 3,367,055 that gun compensators can have an inner and outer tubular portion which when assembled together form an annular gas chamber, with each of the tubular portions having variously shaped openings in both the inner and outer tubular portions to allow for the escape of propellant gases. Specifically, U.S. Pat. No. 2,668,479 discloses the use of six longitudinally spaced circumferential slots in the inner tubular portion and one circumferential slot in the outer tubular portion and spaced forwardly of the slots in the inner tubular portion. In the inner tubular portion disclosed in U.S. Pat. No. 3,367,055 there are numerous circular holes spaced about the circumference of the tube and extending longitudinally along the inner tubular portion, and the outer tubular portion has longitudinally spaced helical slots which are spaced forwardly of the holes in the inner tubular portion.

It is also known from U.S. Pat. No. 2,112,831 that a gun compensator with inner and outer tubular portions can have holes therein which are substantially aligned in the longitudinal direction. However, this gun compensator is adopted for use with a machine gun rather than with other types of firearms. It is also known from U.S. Pat. No. 3,858,481, that a gun compensator with inner and outer tubular portions can have circular openings in the inner tubular portion which are spaced longitudinally and circumferentially, and the outer tubular portion can have longitudinal slots which are spaced circumferentially about the tube. However, in U.S. Pat. No. 3,858,481 the openings in the inner and outer tubular portions of the gun compensator are not aligned longitudinally nor are they provided with any particular type of spacing.

SUMMARY OF THE INVENTION

The present invention provides a compensator for use with a gun having a barrel with a cartridge chamber on one end thereof and a muzzle at the other end with a lug projecting outwardly from the outer surface of the barrel at the muzzle and thereof, wherein the compensator minimizes muzzle jump and recoil and comprises a cylindrical barrel bushing adapted to extend coaxially with and radially outwardly when mounted on the muzzle end of the barrel, said barrel bushing having at one end a bayonet-type of mount for seating and sealing the compensator to the muzzle end of the barrel, said barrel bushing having a longitudinally extending slot which communicates with a radially extending slot into which said lug on the barrel can be received, said barrel bushing having at its other end an internally threaded portion, a complementary externally threaded section on one end of an inner tubular choke for seating and sealing one end of said tubular choke to the muzzle of the barrel, an outer ring extending from the outer surface of the barrel bushing and spaced from the threaded end thereof, an outer tubular housing being seated at one end in sealing relation to the threaded end of the barrel bushing and abutting against sad outer ring thereon, said outer tubular housing being seated at its other end in sealing relation to said inner tubular choke and abutting against a ring extending from the outer surface of said inner tubular choke, said barrel bushing, outer tubular housing, and inner tubular choke defining an annular gas expansion chamber, said outer tubular housing having spaced longitudinally extending slots at the top and bottom thereof, said inner tubular choke having a plurality of holes therein providing gas communication between the barrel, interior of the inner tubular choke and annular gas expansion chamber, said slots in the outer tubular housing providing gas communication between said annular gas expansion chamber and the atmosphere, whereby high pressure gas generated upon firing of a cartridge to propel at least one projectile through said barrel enters the annular gas expansion chamber and discharges to atmosphere through the holes in the outer tubular housing.

BRIEF DESCRIPTION OF THE DRAWINGS

The above as well as other details of the present invention will become apparent upon reading the accompanying description and drawings, in which.

DETAILED DESCRIPTION OF THE INVENTION

Figure 1:
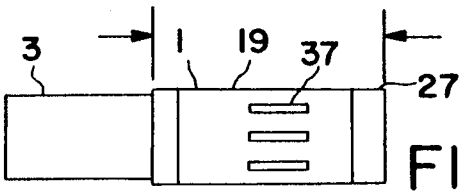
FIG. 1 is a top view of a fully assembled gun compensator according to the present invention.
Figure 2:
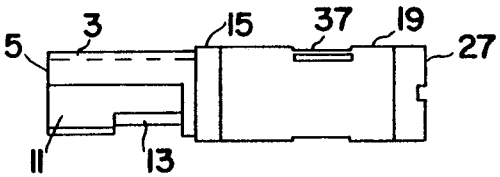
FIG. 2 is a side view of the gun compensator shown in FIG. 1, illustrating the details of the bayonet mount and location of slots or gas ports in the top and bottom of an outer tubular housing.
Figure 3:
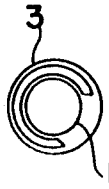
FIG. 3 is an end view of the gun compensator of FIG. 2, illustrating details of the bayonet mount and in dotted lines the wall thickness of the barrel bushing.
Figure 4:
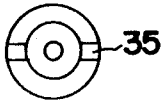
FIG. 4 is an end view of the muzzle end of the gun compensator of FIG. 2, illustrating the location of a slot formed therein for ease of assembly or disassembly.
Figure 8:
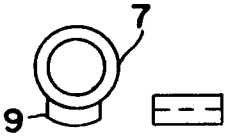
FIG. 8 is an end view of a gun barrel having amounting lug thereon for engagement with the bayonet-type mount on the barrel bushing shown in FIG. 5.

The gun compensator of the present invention shown generally at 1 in FIG. 1 includes a barrel bushing shown generally at 3, which is provided with a hollow interior bore 5 shown by dotted lines in FIG. 2 and as the inner circle in FIG. 3, for slidably receiving the forward end of a gun barrel which is shown generally at 7 in FIG. 8.

An arcuate-shaped projection or lug 9 provided on the outside of the gun barrel 7, FIG. 8, at or near the muzzle end thereof, cooperates with and is slidably received in a longitudinally extending slot 11, and arcuate slot 13 in barrel bushing 3, FIGS. 2 and 3. Slots 11 and 13 extend completely through the wall of the barrel bushing at the inner end thereof to form a bayonet-type locking arrangement between the arcuate-shaped projection or lug 9 on the gun barrel and the barrel bushing 3. The arcuate-shaped lug 9 can be soldered to the barrel, or any other conventional means can be used for securing it to the surface of the barrel. The lug 9 is preferably positioned substantially perpendicular to the axis of the gun barrel 7. The width of the longitudinally extending slot 11 is slightly larger than the arcuate mounting lug 9 so that the latter is slidably received in longitudinal slot 11. Arcuate slot 13 extends substantially perpendicular to the longitudinal axis of barrel bushing 3, and preferably extends about twice the distance radially as the longitudinal slot 11 which communicates therewith.

In mounting gun compensator 1, the muzzle end of the gun barrel 7 is inserted in the bore 5 (FIG. 2) of the barrel bushing 3 with the mounting lug 9 being received in slot 11. When the lug 9 reaches the end of the slot 11, the barrel bushing is then rotated, and the lug then moving out of longitudinal slot 11 and into arcuate slot 13, thereby locking the barrel bushing to the gun barrel 7.

Figure 5:
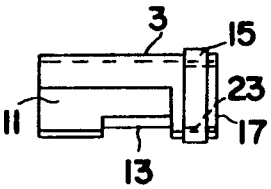
FIG. 5 is a sided view of the disassembled barrel bushing, illustrating in dotted lines the locations of internal threads therein and wall thickness.

Adjacent the other end of barrel bushing 3 is an outer ring or projection 15, projection outwardly from outer wall of barrel bushing 3. Ring 15 is located a predetermined distance inwardly from the extreme outer end 17 of barrel bushing 3 (FIG. 5). Ring 15 preferably extends outwardly from the surface of barrel bushing 3 a distance equal to the wall thickness of an outer tubular housing shown generally at 19 in FIGS. 1, 2, and 6. Outer tubular housing 19 has an internal bore 21, FIG. 6, sized to slidably extend over said extreme outer end 17 of barrel bushing 3 and into abutting engagement with outer ring 15 (FIGS. 1 and 2).

Figure 7:
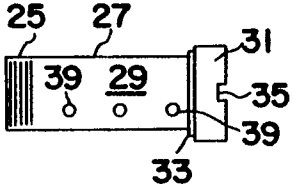
FIG. 7 is a side view of an inner tubular choke, illustrating the threaded end portion thereof and the location of some of the holes formed in the walls thereof.

Barrel bushing 3 has at its outer end interior screw threads 23 which cooperate with screw threads 25 formed on one end of an inner tubular choke shown generally at 27, FIGS. 1, 2, and 7. A number of different sized inner chokes can be used depending upon the shot pattern desired. It is preferred that variations in the amount of choke be obtained by varying the thickness of the wall 29 of the inner tubular choke 27.

Tubular choke 27 preferably has at its outer end a radially extending ring 31. The outer end of the tubular choke 27, just inwardly of ring 31 is somewhat thickened at 33. The outside diameter of the thickened portion 33 is just slightly smaller than the inner diameter or bore 21 of the outer tubular housing 19, (FIG. 6) so that the bore 21 of the forward end of outer tubular housing 19 can be slidably received in the thickened portion 33 of the inner tubular choke 27.

Preferably, the difference between the diameter of the thickened portion 33 and the diameter of ring 31 is approximately equal to the wall thickness of the outer tubular housing 19. However, ring 31 can be larger to make it easier to grip the end of the inner tubular choke 27 when connecting or disconnecting it to barrel bushing 3 by means of the screw threads 25 thereon. A groove 35 is formed in the outer end of inner tubular choke 27 into which a tool (not shown) can be inserted to aid in tightening or loosing inner tubular choke 27 from barrel bushing 3. The outer tubular housing 19 is preferably formed of a single tubular member having a plurality of spaced longitudinally extending rectangular slots 37 therein.

Figure 6:
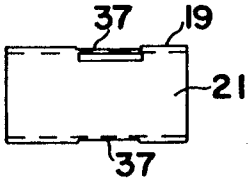
FIG. 6 is a side view of an outer tubular housing, illustrating in dotted lines the wall thickness thereof and location of slots formed therein.

When gun compensator 1 of the present invention is used with a shot gun, it is preferred to have slots 37 formed in the top and bottom portions of outer tubular housing 19 (FIGS. 1, 2 and 6). In a preferred embodiment, three spaced longitudinal extending slots 37 are formed in the top of outer tubular housing 19, and one longitudinally extending slot 37 is formed in the bottom wall of the outer tubular housing 19 (see FIGS. 2 and 6). Although the number of slots in the top and bottom of the outer tubular housing can be varied, it is preferred that the ratio of the area of the top to bottom slots is about 3 to 1. It is also preferred that the slots in the upper surface be spaced about 28° apart as measured from the longitudinal axis of outer tubular housing 19. In a most preferred embodiment, when the compensator is used with a 12-gauge shot gun, each of the slots are preferably about ¾ inches in length and about 0.125 inches in width, and the top slots are spaced about 28° apart, and a single bottom slot extends downwardly.

The inner tubular choke 27 is provided with a plurality of passageways 39 (FIG. 7), preferably circular in shape, which communicate with an annular gas expansion chamber formed between the inner tubular choke 27 and the outer tubular housing 19. In a preferred embodiment, nine circular holes or passageways 39 are formed in the inner tubular choke. In this latter arrangement, it is preferred to provide three spaced longitudinal holes 39, at the bottom, FIG. 7 and three spaced longitudinal holes on either side of the bottom holes. In a most preferred embodiment, each of the circular holes is about 0.175 inches in diameter. When the compensator 1 is used with a 12-gauge shot gun, it is preferred that the outer tubular housing 19 is about 2.1 inches in length, the outer diameter of the inner tubular choke 27 is about 0.900 inches, and the annular space formed between the inner tubular choke 27 and outer tubular housing 19 is about 0.15 inches when measured on a radius from the axis of the inner tubular choke 27.

A series of comparative tests were conducted with a shot gun of the 12-gauge type both with and without the compensator of the present invention. In these tests, a shot gun was mounted on a sled which was resting on three metal tracks. In each test, the gun was fired by means of a string attached to the trigger. In each firing test, the distance travelled by the gun and sled was measured. The distance travelled by the gun and sled with and without the compensator of the present invention were then compared to ascertain whether there was any reduction of the recoil due to the compensator of the present invention. As a result of these tests, it was unexpectedly found that the recoil action of the shot gun with the compensator of the present invention was substantially reduced.

It will thus be seen that there has been provided by the above-described invention a compensator for fire arms which has many thoroughly practical advantages. While preferred embodiments of the invention have been shown and described, it is understood that variations and changes may be resorted to without departing from the spirit of the invention as defined by the appended claims herein.

What I claim is:

1. A compensator for use with a gun having a barrel with a cartridge chamber at one end thereof and a muzzle at the other end with a lug projecting outwardly from the outer surface of the barrel at the muzzle end thereof, wherein said compensator minimizes muzzle jump and recoil and comprises: a cylindrical barrel bushing adapted to extend coaxially with and radially outwardly when mounted on the muzzle end of the barrel, said barrel bushing have at one end a bayonet type of mount for seating and sealing the compensator to the muzzle end of said barrel, said barrel bushing having a longitudinally extending slot which communicates with radially extending slot into which said lug on the barrel can be received, said barrel bushing having at its other end an internally threaded section, a complementary externally threaded section on one end of an inner tubular choke for seating and sealing one end of said tubular choke to the muzzle of the barrel, an outer ring extending from the outer surface of the barrel bushing and spaced from the threaded end thereof, an outer tubular housing being seated at its one end in sealing relation to the threaded end of the barrel bushing and abutting against said outer ring thereon, said outer tubular housing being sealed at its other end in sealing relation to said inner tubular choke and abutting against an outer ring extending from the outer surface of said inner tubular choke, said barrel bushing, outer tubular housing, and inner tubular choke defining an annular gas expansion chamber, said outer tubular housing having spaced longitudinally extending slots in the top and bottom thereof, said inner tubular choke having a plurality of holes therein providing gas communication between the gun barrel, interior of the inner tubular choke, and annular gas expansion chamber, said slots in the outer tubular housing providing gas communication between said annular gas expansion chamber and the atmosphere, whereby high pressure gas generated upon firing of a cartridge to propel at least one projectile through said barrel enters the compensator and a portion of said high pressure gas moves radially outwardly through the annular gas expansion chamber to the atmosphere.

2. The compensator of claim 1, wherein the ratio of the area of the slots in the top surface of the outer tubular housing to the area of the slots in the bottom of the outer tubular housing is about 3 to 1.

3. The compensator of claim 1, wherein the holes formed in the inner tubular choke are circular.

4. The compensator of claim 2, wherein at least three longitudinal slots are formed in the top of the outer tubular housing and at least one longitudinal slot is formed in the bottom thereof.

5. The compensator of claim 3, wherein at least nine-spaced holes are formed in the inner tubular choke, with at least three-spaced holes being formed at the bottom and at least two rows of spaced holes being formed on either side of the bottom holes.

6. The compensator of claim 1, wherein the compensator is for use on a shot gun and the outer tubular housing has an interior diameter of about 1.05 inches and a length of about 2.1 inches, and the inner tubular choke has an outside diameter of about 0.9 inches.

7. The compensator of claim 1, wherein said inner tubular member has a groove in the end thereof.

8. The compensator of claim 1, wherein said inner tubular choke comprises longitudinally spaced and diametrically opposed circular holes, and said outer tubular housing comprises at least three longitudinal slots spaced circumferentially about an upper portion, and at least one longitudinal slot spaced from the upper three slots such that the lower slots diametrically oppose the uppermost slots.

9. The compensator of claim 5, wherein said holes in the bottom of the inner tubular choke are in substantial alignment in the longitudinal direction with the slot in the bottom of the outer tubular housing.

* * * * *